US010655235B1

(12) United States Patent
Li

(10) Patent No.: US 10,655,235 B1
(45) Date of Patent: May 19, 2020

(54) METHOD FOR PREPARING A SINTERED NICKEL ALKALINE WATER ELECTROLYSIS ELECTRODE

(71) Applicant: Haiming Li, Stoughton, MA (US)

(72) Inventor: Haiming Li, Stoughton, MA (US)

( * ) Notice: Subject to any disclaimer, the term of this patent is extended or adjusted under 35 U.S.C. 154(b) by 0 days.

(21) Appl. No.: 16/701,636

(22) Filed: Dec. 3, 2019

(51) Int. Cl.
*C25B 11/04* (2006.01)
*C25B 11/03* (2006.01)

(52) U.S. Cl.
CPC ..... *C25B 11/0431* (2013.01); *C25B 11/035* (2013.01)

(58) Field of Classification Search
CPC ..... C25B 11/0431; C25B 11/035
See application file for complete search history.

(56) References Cited

PUBLICATIONS

Savaris et al., Porous Ni Electrodes for Hydrogen Production from Water Electrolysis, International Conference on Renewable Energies and Power Quality (ICREPQ'13), Bilbao (Spain), Mar. 20-22, 2013 Renewable Energy and Power Quality Journal (RE&PQJ) ISSN 2172-038 X, No. 11, Mar. 2013 (Year: 2013).*

* cited by examiner

*Primary Examiner* — Jessee R Roe
*Assistant Examiner* — Rebecca Janssen

(57) ABSTRACT

The invention provides, among other things, a method for preparing a sintered nickel alkaline water electrolysis electrode for electrolytic hydrogen production. This method utilizes sintering furnace, ball-millings the mixture of nickel carbonate and selected nickel powder to obtain the raw material, adds polyvinyl alcohol to get the die under cold-pressing effect, sintering to make porous sintered nickel. In some embodiments, the surface of a nickel mesh used for the electrode is larger than the surface of the nickel mesh usually used in conventional hydrogen generation equipment and exhibits high-level catalytical activity and stability of hydrogen evolution. The proposed method is simple, easy to operate and has low production cost, which is suitable for electrolytic reactions under high current density conditions.

4 Claims, 7 Drawing Sheets

METHOD FOR PREPARING A SINTERED NICKEL ALKALINE WATER ELECTROLYSIS ELECTRODE

TECHNICAL FIELD

The invention relates generally to electrolytic hydrogen production, and more specifically to a method for preparing an inorganic porous material for the alkaline water electrolysis electrode.

BACKGROUND AND PRIOR ART

Hydrogen is a high-efficiency and clean secondary energy source with the advantages of high combustion value, abundant resources and renewability. Hence, the desirability of generating and utilizing hydrogen has been widely recognized by countries all over the world. There are many preparation methods for hydrogen, including hydrogen production using fossil energy (where natural gas or methane is passed through a special reformer which reacts steam at high temperature to obtain the hydrogen), as an industrial by-product and by water electrolysis. Water electrolysis is an easy-to-operate hydrogen production process, resulting in a purity of hydrogen high enough for electrolysis to be widely used in the industry. In recent years, the utilization of renewable energy sources has been promoted to address the serious environmental pollution problems associated with fossil energy sources. Hydrogen production by water electrolysis has become an important task as a large amount of wind and hydropower resources cannot be integrated into electricity generation.

Although hydrogen production technology for water electrolysis has been widely used in the industry, the electric energy consumption for hydrogen evolution is large and energy transformation efficiency is low due to the increase of cell voltage during the process of water electrolysis. Currently, in the alkaline water electrolysis industry, the material used in the cathode during the hydrogen evolution process is nickel. However, the overpotential of hydrogen evolution is high, reaching 480 mV. In order to render alkaline water electrolysis more suitable for widespread use in hydrogen production, it is desirable to reduce the electricity consumption during the process of water electrolysis.

Porous nickel catalytic material has been researched for a long time, and various nickel-based electrodes have been developed. For example, U.S. Pat. No. 4,447,302A describes a porous electrode, hot pressed from nickel powder for alkaline water electrolysis, which is alloyed with 1-15% by weight of titanium, a precious metal. Further, Ragunathan et al. describe a method for preparing porous nickel electrodes by repeated spray coating, drying and pressing the nickel mix, and then sintering in a hydrogen atmosphere under 900-1000° C. ("Porous nickel electrodes in water electrolysis 1. Electrode preparation and polarization studies in strong alkali," International Journal of Hydrogen Energy, Volume 6, Issue 5, 1981, Pages 487-496). In this research, the nickel mix consists of fine carbonyl nickel powder, nickel oxalate and methyl cellulose suspended in water, forming a thin paste. These and many other prior-art approaches make use of expensive raw materials, and increase the complexity of the preparation process.

SUMMARY

The invention provides, in various embodiments, a high-efficiency porous nickel cathode catalytic material for hydrogen evolution by water electrolysis, as well as methods of making such material. As such, this material can reduce the overpotential of hydrogen evolution and improve the electro-catalytic activity at the cathode during the process of water electrolysis, which can directly and effectively reduce electricity consumption and, thus, the cost of hydrogen production by water electrolysis.

The invention only uses nickel carbonate powder as the additive, which is added without any other elements. The method used in the invention is more economical and easier to prepare the electrode. The sintering decomposes into $CO_2$ and NiO. Hence, no other impurity will remain after sintering. Additionally, the $CO_2$ produced by sintering benefits the formation of sintered nickel porous structure.

A method for preparing a sintered nickel alkaline water electrolysis electrode includes, in accordance with one example embodiment, the following steps:

Step 1: Add 10~20 wt. % nickel carbonate to a chosen nickel powder with an average particle size of 20 or 50 microns and mix it evenly. After 24~72 hours of ball-milling at 10~400 rounds per minute (rpm), obtain a second nickel powder having an average particle size of 5~50 microns.

Step 2: Add 0.5~5 wt. % polyvinyl alcohol to the second nickel powder. Form nickel dies under cold-pressing agglomeration at a pressure of 100~300 MPa.

Step 3: Put the dies into a vacuum sintering furnace. After the vacuum reaches $1\times10^{-3}$~$1\times10^{-4}$ Pa, start to raise the temperature. The temperature increases to 200~350° C. at a heating rate of 1~2° C./min. Keep dies at the raised temperature for 10~30 minutes. Then, the temperature increases further to 800~1000° C. at a heating rate of 0.5~1° C./min. Keep dies at that further raised temperature for about 60 minutes to obtain the porous sintered nickel dies.

Step 4: The porous sintered nickel dies are homogenized at 500~600° C. Keep them within this temperature range for 2~6 hours to obtain porous nickel material.

The disclosed method and electrode material can provide multiple benefits:

The electrode material for hydrogen production by water electrolysis can be made by a simple preparation process and at low sintering temperature, providing energy savings.

The porous nickel material resulting from the disclosed process utilizes the small pores between the powders in the die and nickel carbonate decomposition reaction during the process of sintering to make pores. The pores are uniform in size (observed by SEM), as confirmed by testing the material performance by electro-chemical analysis. The diameters of the pores are between 1 and 500 micrometers as observed by scanning electron microscopy (SEM). Through the process, it is possible to obtain a porous cathode material with a high specific surface area.

The use of nickel as a raw material for the preparation of porous material, which can prevent acid and alkali corrosion, is suitable for the electrolyte environment that is used for hydrogen production by water electrolysis. The porous sintered nickel electrode has broad application prospects in the field of hydrogen production by water electrolysis.

DETAILED DESCRIPTION OF EXAMPLE EMBODIMENTS

Figure 4:
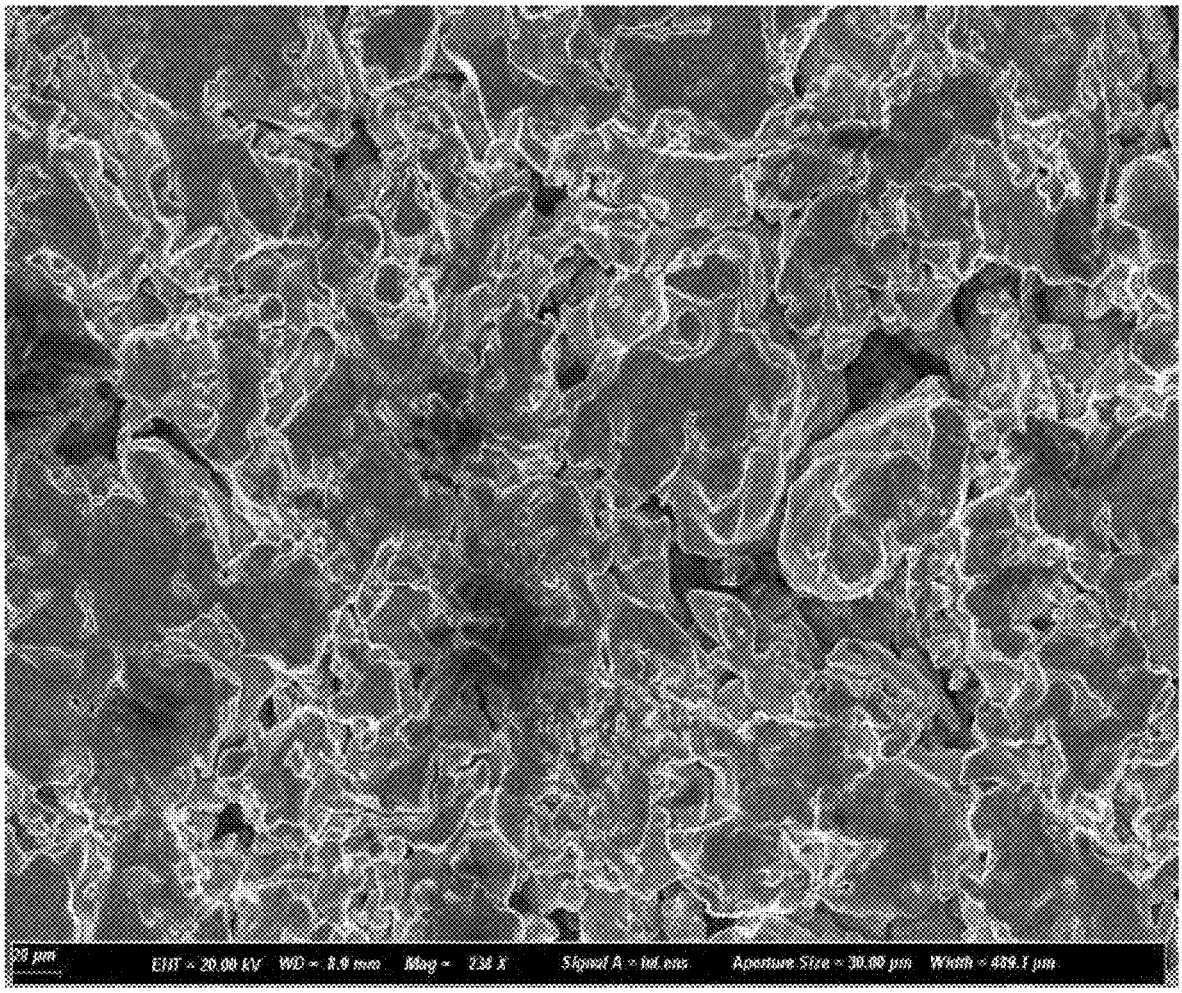
FIG. 4 is an SEM image of the porous nickel material according to the first example embodiment.

FIG. 4 illustrates an example method for preparing an inorganic porous material. And various example embodiments will be further described below in conjunction with the accompanying drawings. However, the scope of the invention is not limited to the details described below.

Example 1

First, a nickel powder with an average particle size of 20 microns and a nickel carbonate at analytical purity are selected to form a mixture according to a ratio of the weight of nickel powder to the total weight of nickel powder and nickel carbonate of 80%. The raw material (nickel powder mixture) is obtained after 30 hours ball-milling (101). Next, 2.5% polyvinyl alcohol is added to the raw material (nickel powder mixture), and a die is obtained by cold pressing under 120 MPa pressure (102). Then, the die is placed into a vacuum sintering furnace. The temperature is raised after the vacuum reaches $6\times10^{-4}$ Pa. The temperature is raised to 520° C. with a heating rate of 1.5° C./min. The die is kept at this temperature for 30 minutes. After that, the temperature is raised to 800° C. with a heating rate of 0.5° C./min. The die is kept at this temperature for 60 minutes to obtain the porous sintered nickel die (103). Lastly, the porous sintered nickel die is homogenized at 550° C. for 2~6 hours to obtain porous nickel material (104).

Figure 1:
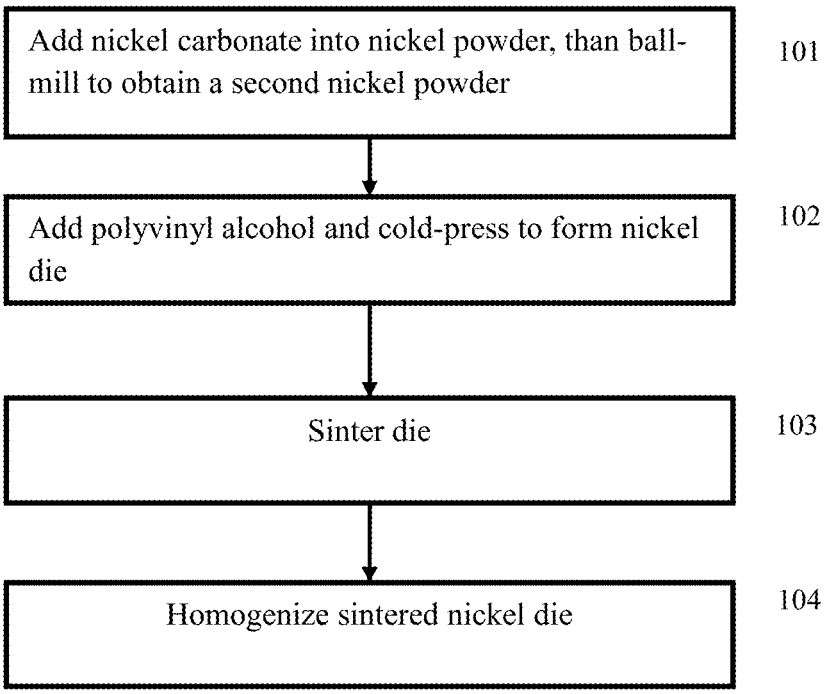
FIG. 1 is a flow chart tracing the steps of preparing a sintered nickel alkaline water electrolysis electrode.
Figure 2:
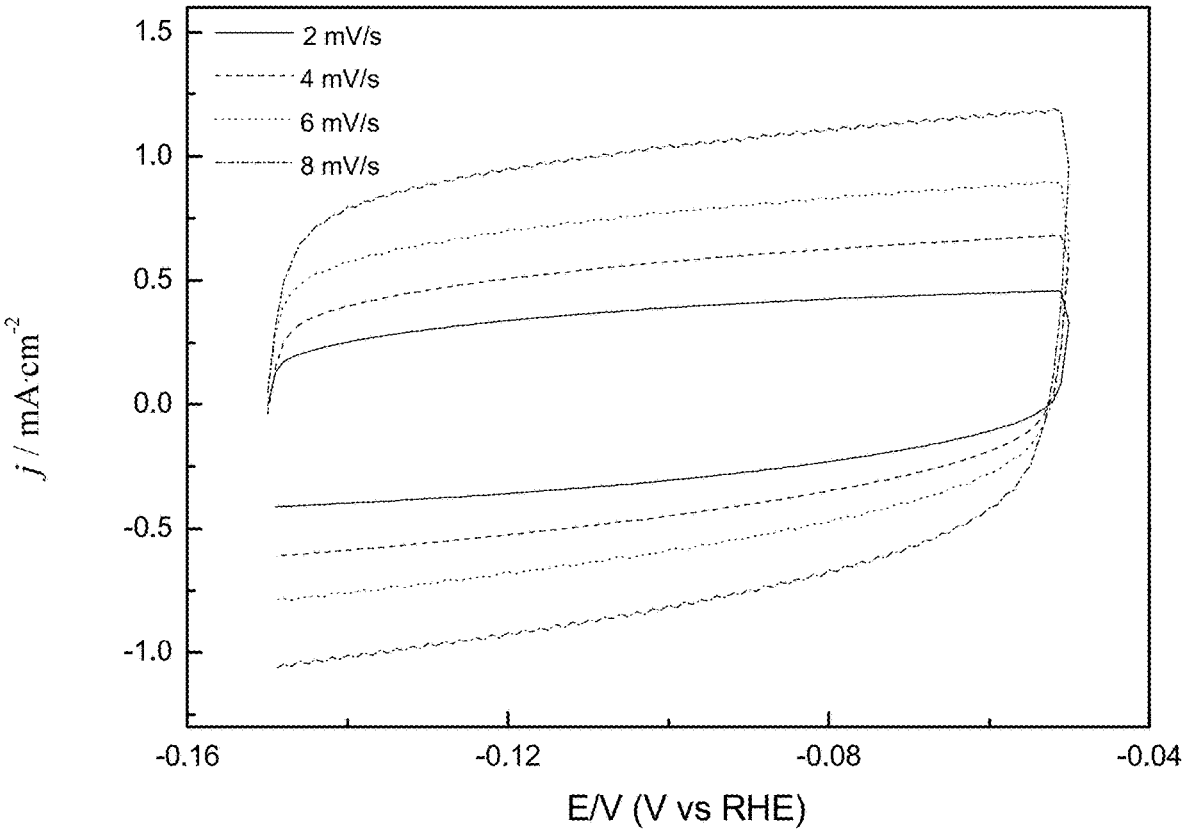
FIG. 2 is a cyclic voltammogram of a porous nickel material prepared, in accordance with a first example embodiment, from 20-micrometer particles at between −0.15V and 0.05V, taken under scanning speeds of 10, 30, 50, 70, 100 mV/s.
Figure 3:
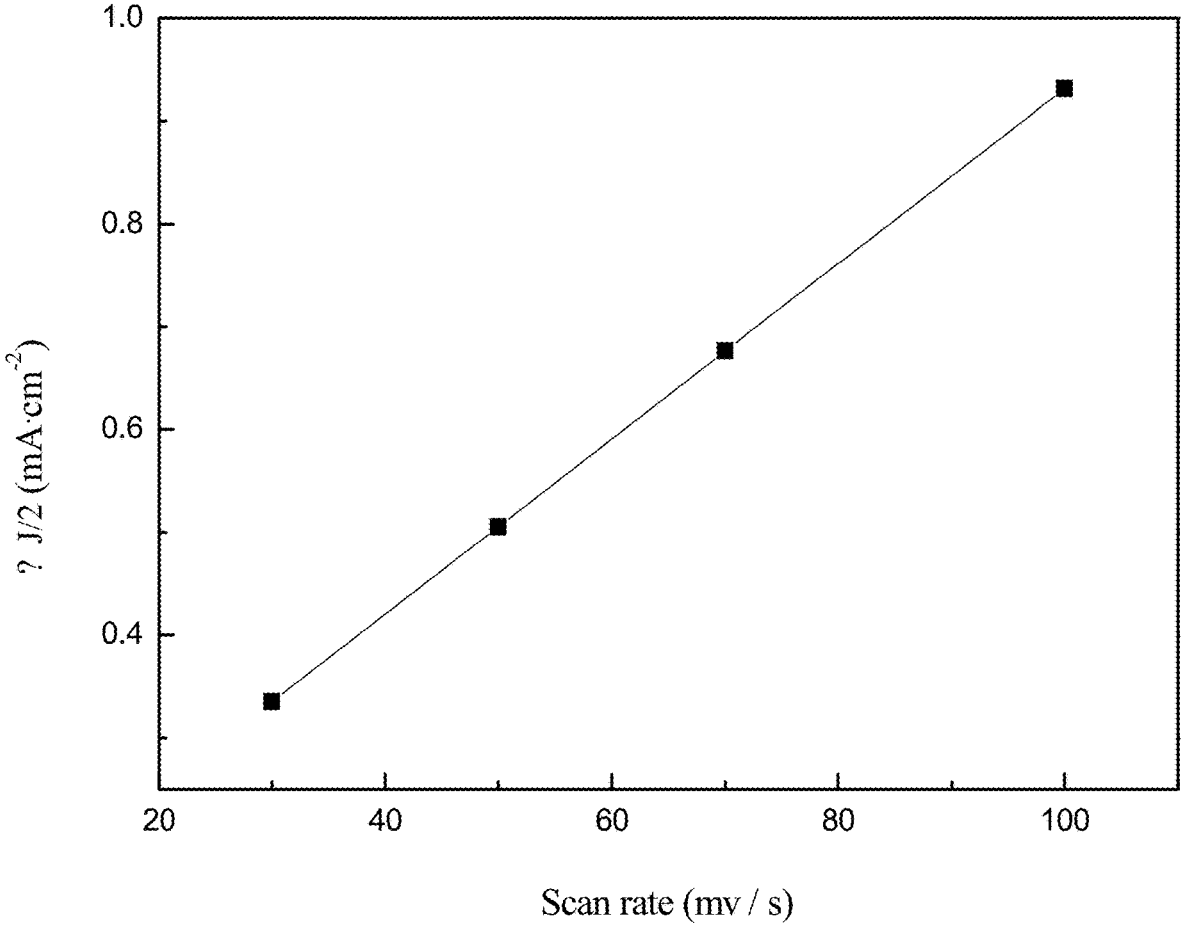
FIG. 3 is a graph illustrating the relationship between current capacity and scanning speed of the porous nickel material according to the first example embodiment.

To characterize the catalytic activity of the prepared porous nickel material, cyclic voltammograms are obtained by subjecting the material to a cyclic voltage between −0.15 V to −0.05 V at scanning speeds of 2, 4, 6, and 8 mV/s (FIG. 2). The selected measurement range is determined to be −0.15V~−0.05V, because there is no obvious Faraday reaction under this potential window. FIG. 3 plots the measured current capacity as a function of scanning speed, showing that the current capacity and scanning speed are linearly related. The slope of a linear fitted curve (also shown in FIG. 3) is the capacitance of the porous material, which is, in this example, 8.2 $mF\cdot cm^{-2}$. The weight of the porous nickel electrode was 44.7 $mg\cdot cm^{-2}$. It is known that the specific capacitance of a nickel flat electrode is 40 $\mu g\cdot cm^{-2}$. See, e.g., Kibsgaard J., et al., Designing an improved transition metal phosphide catalyst for hydrogen evolution using experimental and theoretical trends [J]. Energy & Environmental Science, 2015, Issue 10. The specific surface area for porous material is 0.458 $m^2/g$ according to the equation:

$$S = \frac{A}{M} = \frac{\frac{C_1}{C_s}\times 1\ \text{cm}^2}{m_1\times 1\ \text{cm}^2} = \frac{\frac{8.2\times 1000}{40}\times 1/10000\ (\text{m}^2)}{44.7/1000\ (\text{g})} = 0.458\ \text{m}^2/\text{g}$$

where

S—Calculated specific surface area

A—Surface area of 1 $cm^2$ sample

M—Weight of 1 $cm^2$ sample $m_1$—Unit weight of porous nickel electrode in example 1

$C_1$—Capacitance of the porous nickel electrode in example 1

$C_s$—Capacitance of the nickel flat electrode

FIG. 4 shows the SEM image of porous electrodes under the condition described above. It can be seen from the FIG. 4 that the nickel cathode material obtained by sintering under this condition has a layered and porous structure. Additionally, the activity area is relatively large.

Example 2

First, a nickel powder with an average particle size of 50 microns and a nickel carbonate at analytical purity are selected to form a mixture according to a ratio of the weight of nickel powder to the total weight of nickel powder and nickel carbonate of 80%. The raw material (nickel powder mixture) is obtained after 30 hours ball-milling (101). Next, 2.5% polyvinyl alcohol is added to the raw material (nickel powder mixture), and a die is obtained by cold pressing under 120 MPa pressure (102). Then, the die is placed into a vacuum sintering furnace. The temperature is raised after the vacuum reaches $6\times10^{-4}$ Pa. The temperature is raised to 520° C. with a heating rate of 1.5° C./min. The die is kept at this temperature for 30 minutes. After that, the temperature is raised to 800° C. with a heating rate of 0.5° C./min. The die is kept at this temperature for 60 minutes to obtain the porous sintered nickel die (103). Lastly, the porous sintered nickel die is homogenized at 550° C. for 2~6 hours to obtain porous nickel material (104).

Figure 5:
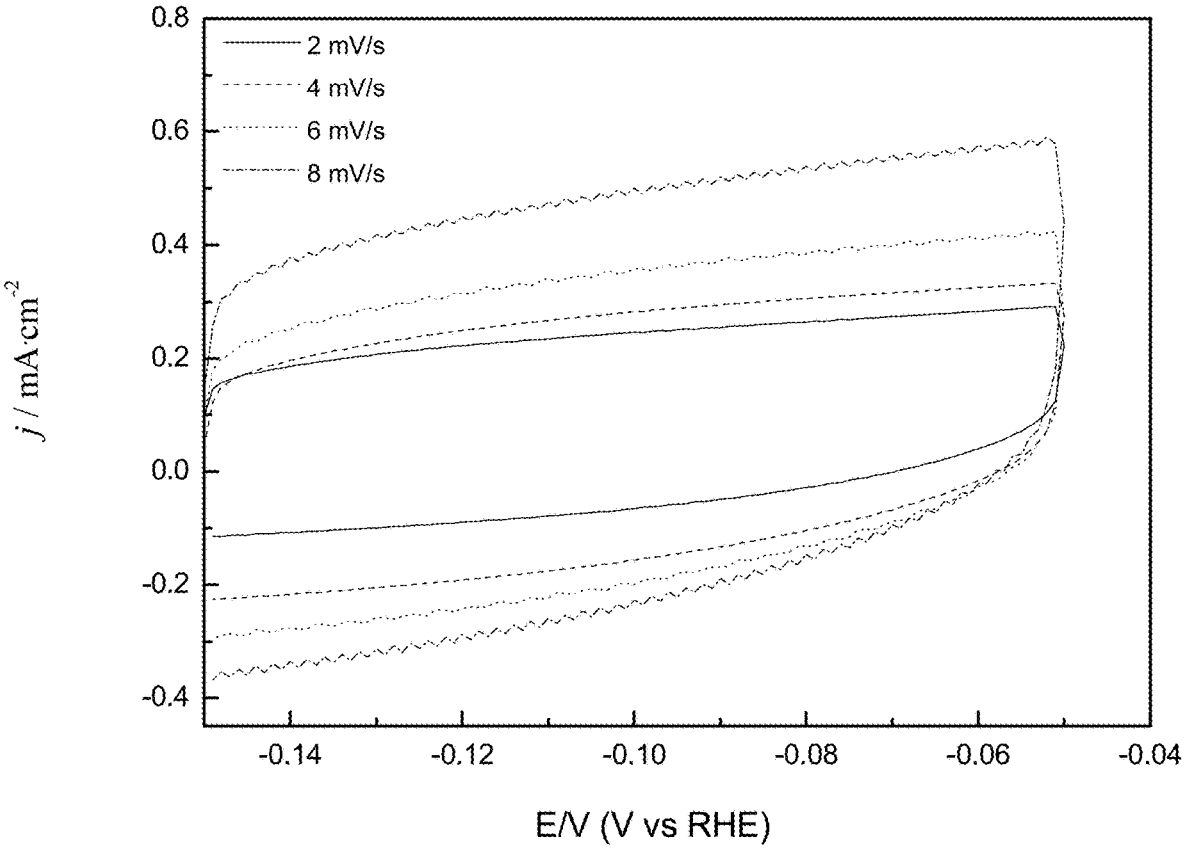
FIG. 5 is a cyclic voltammogram of a porous nickel material prepared, in accordance with a second example embodiment, from 50-micrometer particles at between 0.15 V and 0.05 V, taken under scanning speeds of 10, 30, 50, 70, 100 mV/s.
Figure 6:
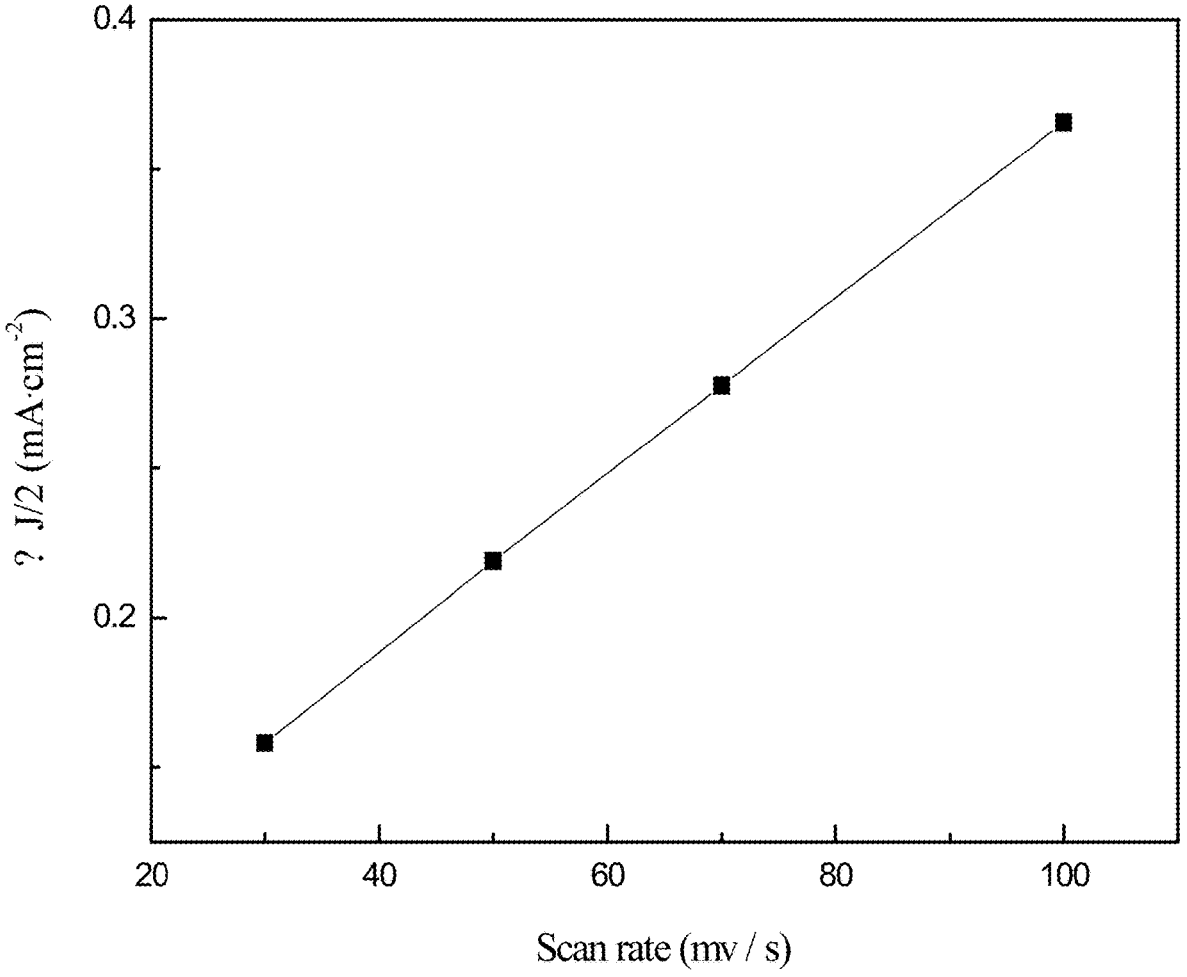
FIG. 6 is a graph illustrating the relationship between current capacity and scanning speed of the porous nickel material according to the second example embodiment.

To characterize the catalytic activity of the prepared porous nickel material, cyclic voltammograms are obtained by subjecting the material to a cyclic voltage between 0.15V to −0.05V at scanning speeds of 2, 4, 6, and 8 mV/s (FIG. 5). The selected measurement range is determined to be −0.15V~−0.05V, because there is no obvious Faraday reaction under this potential window. FIG. 6 plots the measured current capacity as a function of scanning speed, showing that the current capacity and scanning speed are linearly related. The slope of a linear fitted curve (also shown in FIG. 6) is the specific capacitance of the porous material, which is, in this example, 1.65 $mF\cdot cm^{-2}$. The weight of the porous electrode was 43.9 $mg\cdot cm^{-2}$. The calculated specific surface area for porous material is 0.165 $m^2/g$ according to the equation:

$$S = \frac{A}{M} = \frac{\frac{C_s}{C_s}\times 1\ \text{cm}^2}{\text{m}_2\times 1\ \text{cm}^2} = \frac{\frac{1.65\times 1000}{40}\times 1/10000\ (\text{m}^2)}{43.9/1000\ (\text{g})} = 0.165\ \text{m}^2/\text{g}$$

where

S—Calculated specific surface area

A—Surface area of 1 $cm^2$ sample

M—Weight of 1 $cm^2$ sample $m_2$—Unit weight of porous nickel electrode in example 2

$C_2$—Capacitance of the porous nickel electrode in example 2

$C_s$—Capacitance of the nickel flat electrode

Figure 7:
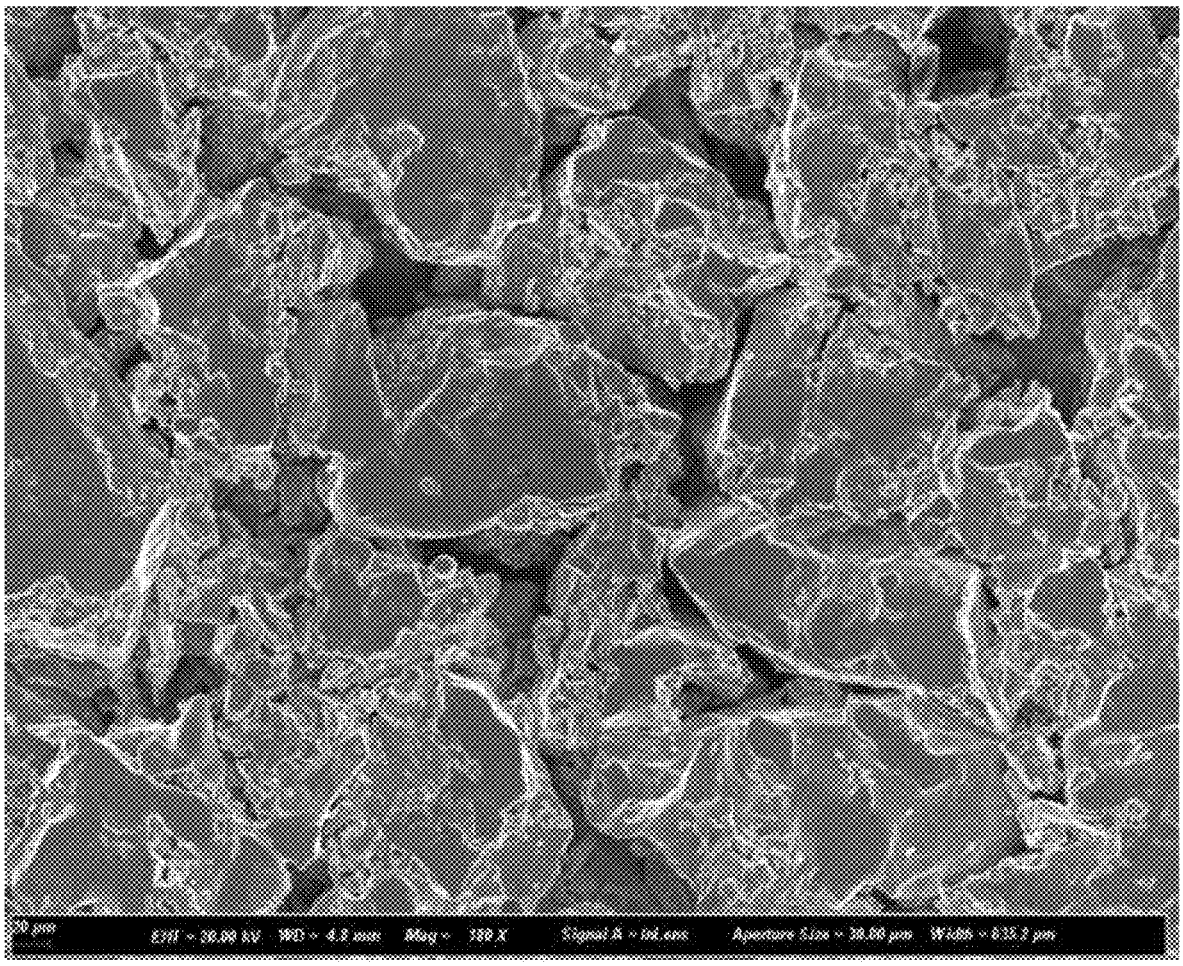
FIG. 7 is an SEM image of the porous nickel material according to the second example embodiment.

FIG. 7 shows the SEM image of porous electrodes under the condition described above. It can be seen from the figure that the nickel cathode material obtained by sintering under this condition is blocky, the layered structure is not obvious, the number of porosity is small, and the pore diameter is large.

What is claimed is:

1. A method for preparing a porous sintered nickel alkaline material for a water electrolysis electrode, the method comprising:

ball-milling a mixture of a first nickel powder and between 10 and 20% by weight nickel carbonate to create a second nickel powder comprising particles having a diameter between 5 and 50 micrometers;

adding between 0.5 and 5% by weight polyvinyl alcohol to the second nickel powder;

forming nickel dies from the second nickel powder by cold-pressing agglomeration;

sintering the nickel dies in a vacuum sintering furnace at a temperature that is raised from an initial temperature to an upper temperature between 800 and 1000° C. to create porous sintered nickel dies; and homogenizing the porous sintered nickel dies to obtain the porous sintered nickel alkaline material.

2. The method of claim 1, wherein the porous sintered nickel dies have a pore size of between 1 micrometer and 500 micrometers.

3. The method of claim 1, wherein the mixture is made of 80% weight of nickel powder and 20% weight of nickel carbonate.

4. The method of claim 1, wherein the homogenizing step a temperature between 500 and 600° C. for between 2 and 6 hours.

* * * * *